United States Patent [19]

Chang

[11] Patent Number: 5,009,356

[45] Date of Patent: Apr. 23, 1991

[54] REMOVABLE MAGAZINE FOR STAPLE GUNS

[76] Inventor: Ted Chang, No. 204-2, Chiung Lin Rd., Hsin Chuang City, Taipei Hsien, Taiwan

[21] Appl. No.: 461,679

[22] Filed: Jan. 8, 1990

[51] Int. Cl.[5] ..... B27C 5/02; B25C 5/02

[52] U.S. Cl. ..... 227/120; 227/123; 227/128

[58] Field of Search ..... 227/123, 120, 128

[56] References Cited

U.S. PATENT DOCUMENTS 4,405,073 9/1983 Escalante ..... 227/120
4,756,462 7/1988 Ebihara ..... 227/120
4,784,307 11/1988 Ebihara ..... 227/120

*Primary Examiner*—Timothy V. Eley
*Attorney, Agent, or Firm*—Poms, Smith, Lande & Rose

[57] ABSTRACT

Staple guns include a striker and a removable magazine housed by a pair of side plates. The removable magazine is substantially elongated and "U" sectioned to contain staples. The removable magazine is slidable against the staple gun by means of a plurality of protrusions formed on the two sides thereof to co-operate with a pair of grooves formed on the internal surfaces of the side plates. A pair of retainers are provided to keep the removable magazine in its location inside the housing of staple guns. By disengaging the retainers, the removable magazine is removable from staple guns.

3 Claims, 3 Drawing Sheets

REMOVABLE MAGAZINE FOR STAPLE GUNS

BACKGROUND OF THE INVENTION

The present invention relates to staple magazines for staple guns and particularly to a removable magazine for a staple gun.

A staple gun usually includes a magazine securely fixed inside the housing of the staple gun to contain bolt staples and a spring-biased striker operated by a handle together with a striking mechanism. The striker is moved against the spring and then released to eject a staple from the magazine. In order that the support for the striking mechanism has sufficient strength, the staple gun is generally manufactured such that the housing of the staple gun is usually not openable which differs from the structure of a handle stapler which is openable to load staples into the magazine and to have the magazine cleared in case it jams with staples. Not being openable, the staple gun is loaded from a rear opening and the staples pushed forward to an ejection slot by a spring-biased pusher. This causes no inconvenience. However, a staple forced out of the ejection slot by the striker undergoes severe deformation so that the ejection slot inadvertently jams with a staple which has not been smoothly ejected out of the ejection slot. In this case, a staple gun with a conventional magazine will have problems in clearing the jammed ejection slot which cannot be observed directly.

SUMMARY OF THE INVENTION

It is therefore the object of the present invention to provide a removable magazine for staple guns such that when the ejection slot is jammed, the magazine is detachable in order to clear the jammed slot easily.

The invention is now described with reference to preferred embodiments thereof shown in the accompanying drawings.

DETAILED DESCRIPTION OF THE PREFERRED EMBODIMENTS

Figure 1:
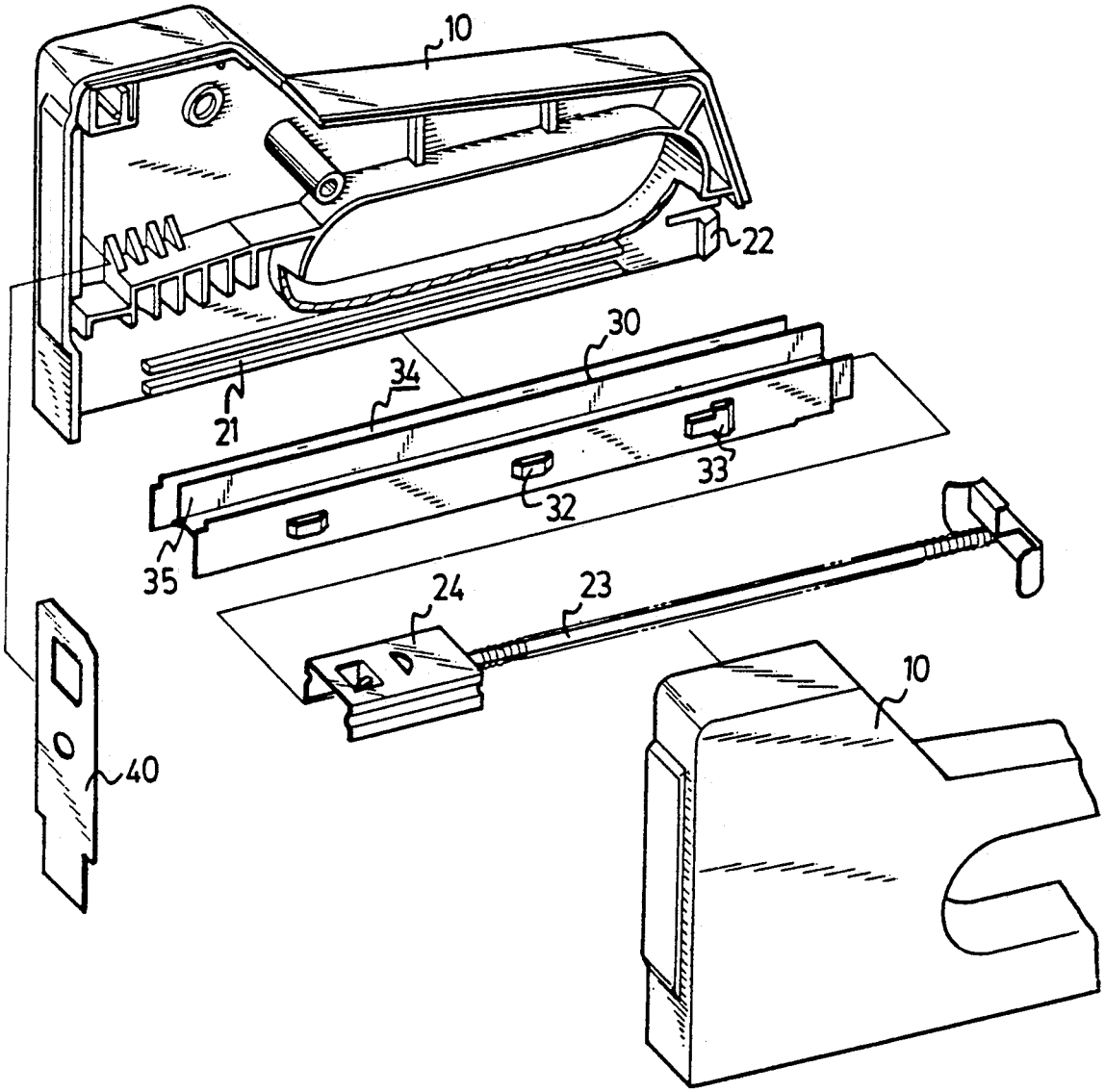
FIG. 1 shows an exploded view of a staple gun with a removable magazine in accordance with the present invention, wherein the striking mechanism, along with the handle, has been removed.

Referring now to the drawings, wherein the prior art handle and striking mechanism of the staple guns are not shown. Staple guns comprise a magazine 30 for containing staples which are urged within the magazine 30 toward an ejection slot 50 by means of a spring-biased pusher 24 and a striker 40 which comprises a movable member within the ejection slot 50. The striker 40 is spring-biased and is movable against the bias spring (not shown) to a position in which the entire striker 40 is located above the ejection slot 50 by means of a striking mechanism together with a handle. On subsequent operation of the staple guns, the striker 40, under the action of the spring, moves toward the ejection slot 50 rapidly, thus striking the staple within the ejection slot 50 and forcibly ejecting the staple.

The housing of a staple gun is constituted by two side plates 10. Within the housing, a removable magazine 30 to be described in more detail is disposed with a retainer 22 formed on each of the side plates 10 to retain the magazine 30 in position. A striker 40 is located within the housing at one end of the magazine 30.

Figure 3:
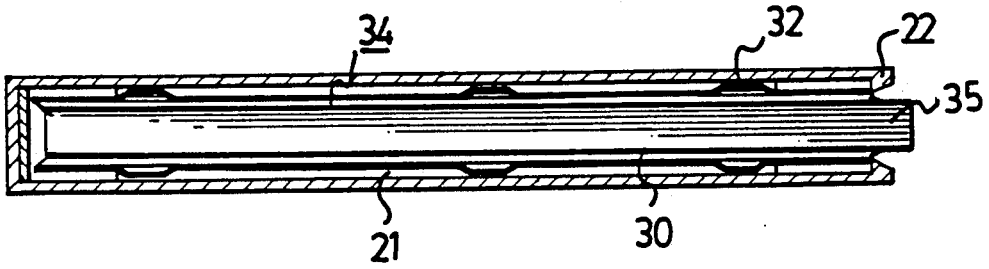
FIG. 3 is a section taken on line 3—3 in FIG. 2.
Figure 4:
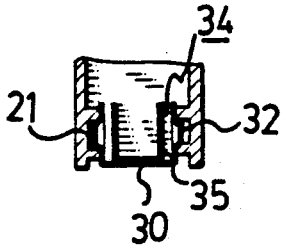
FIG. 4 is a section taken on line 4—4 in FIG. 2.

The magazine 30 is an elongate substantially "U" sectioned member with a plurality of protrusions 32 formed on the outside surface of its limbs. The protrusions 32 are disposed in parallel with the bottom of the magazine 30. A groove 21 associated with the protrusions 32 of one limb of the magazine 30 is formed on the inside surface of each of the side plates 10 to co-operate with the protrusions 32 in order to guide and secure the magazine 30 within the housing. FIGS. 3 and 4 show the disposal of the magazine 30 within the housing and the relationship between the magazine 30 and the grooves 21. The grooves 21 are disposed such that the magazine 30 is slidable in or out of the housing under the guidance of the grooves 21, when the retainers 22 have been disabled.

Figure 2:
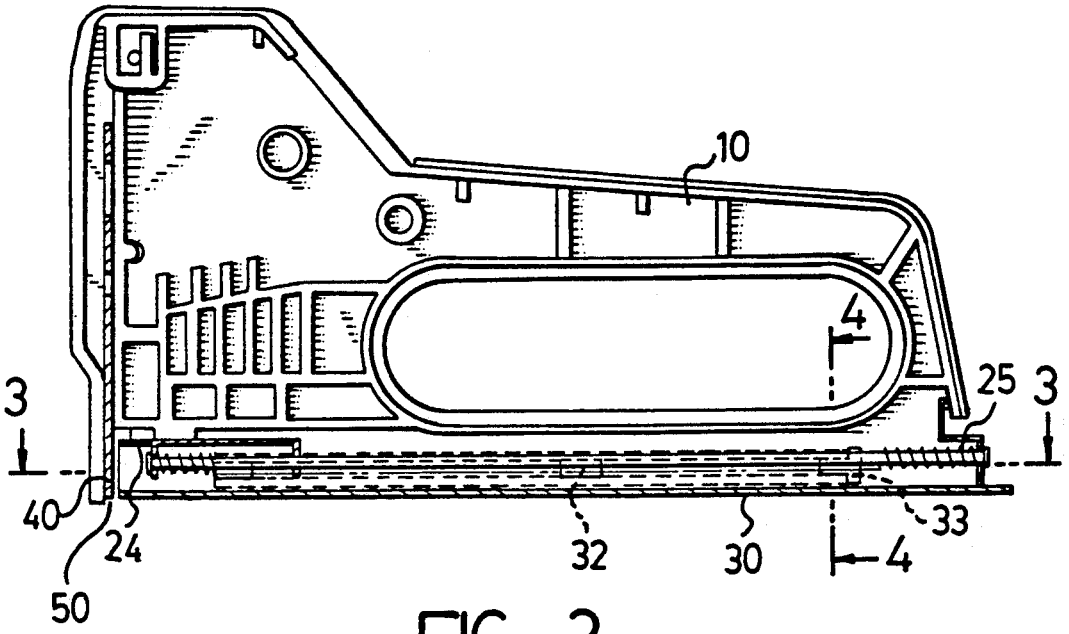
FIG. 2 shows a cross-sectional side view of the assemblage of parts shown in FIG. 1.

Conventionally, staples (not shown in the drawings) comprise a plurality of "U" shaped members which are secured adjacent one another to form an elongate substantially "U" sectioned strip. Referring now back to FIG. 1, in order to firmly secure the staples in a position within the removable magazine 30, a slot 34 is formed on each side of the magazine 30 by installing an elongate sheet 35 inside the magazine 30 and in parallel with the side of the magazine that it is associated with. The staples are contained in the magazine 30 with each of its legs disposed in one of the slots 34. The staples are pushed towards an ejection slot 50 (see FIG. 2) by means of a prior art spring-biased pusher 24.

Further, the magazine 30 has a stop 33 formed on the outside surface of each of its limb to prevent the magazine 30 from being further pushed forwards by abutting against the rear end of the grooves 21.

Figure 5:
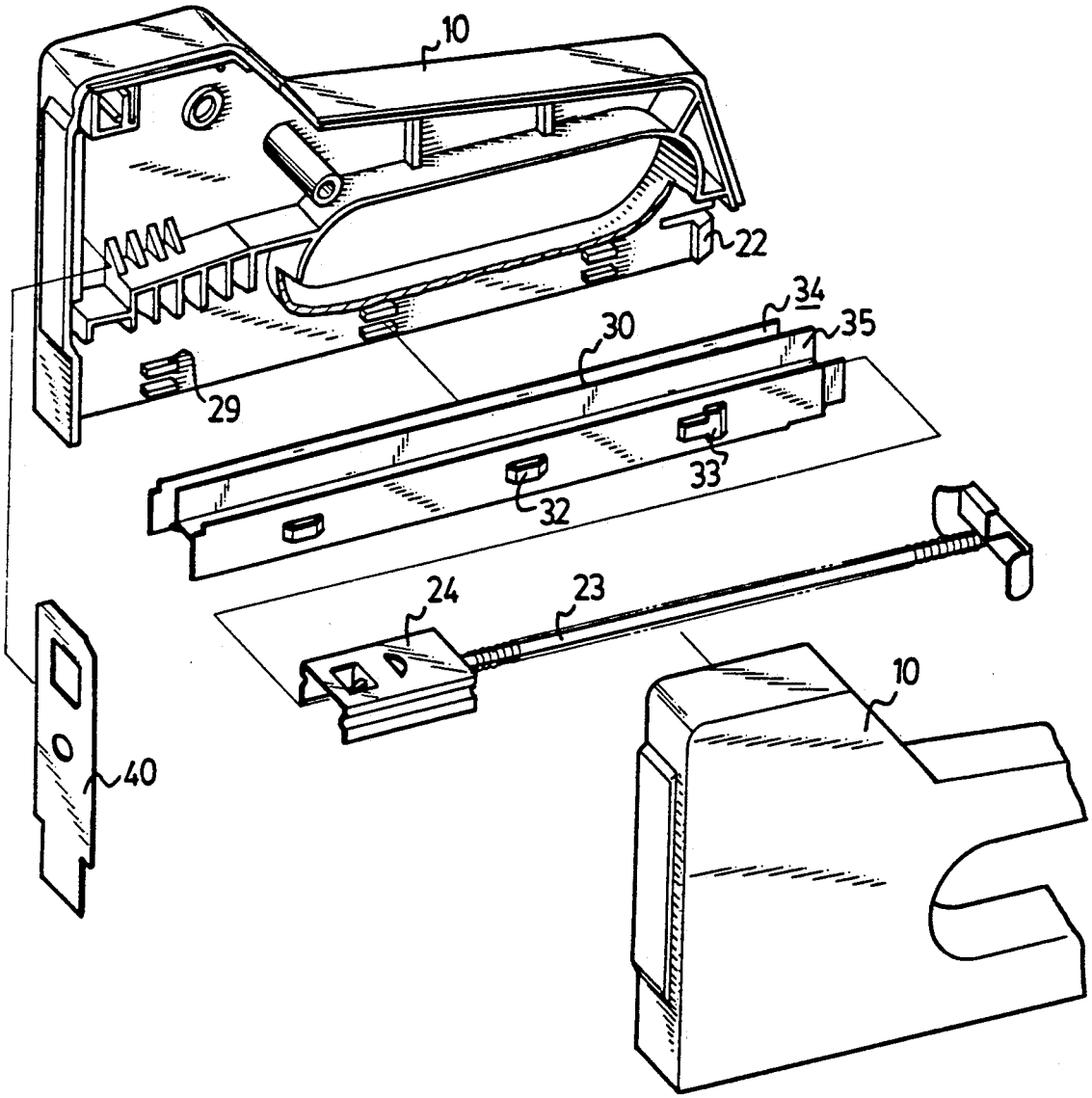
FIG. 5 shown another embodiment of the present invention.

Referring to FIG. 5, wherein another embodiment of the present invention is shown, the grooves 21 of FIG. 1 are replaced by a plurality of paired guide blocks 29. Each pair of the guide blocks 29 are spaced so as to allow one of the protrusions 32 of the magazine 30 to be inserted between a pair of the guide blocks 29. The guide blocks 29 are so disposed that when the magazine 30 is inserted into the housing, each of the protrusions 32 is positioned between a pair of guide blocks 29 so as to keep the magazine 30 from falling out of the housing. With this construction, the magazine 30 is conveniently removed from the housing after being slightly pulled backwards in order to disengage the protrusions 32 from the guide blocks 29 and then pulled downwards.

It will be appreciated that the invention is not limited to the embodiments illustrated and described, but may be modified in various way within the scope of the appended claims.

I claim:

1. A staple gun comprising a housing which is constituted by two side plates, a striker, a striking mechanism including a handle, and a magazine together with a spring-biased staple pusher and characterized in that said magazine is an elongated substantially "U" sectioned member having two limbs each with a plurality of protrusions formed on an outside surface thereof to co-operate with a groove formed on an inside surface of each said side plate, said grooves being so disposed that said magazine is slidable therealong with said protrusions inserted thereinto, each of said side plates further having a retainer disposed at the rear end of said magazine so as to retain said magazine within said housing, said magazine further having a stop formed on the outside surface of each of the limbs thereof to prevent said magazine from being further pushed forwards by abutting the rear ends of said grooves.

2. A staple gun as claimed in claim 1, wherein said grooves formed on the inside surfaces of said side plates are replaced by a plurality of paired guide blocks which are so disposed that when said magazine is inserted into said housing, each of said protrusions formed on said magazine is positioned between one of said pairs of guide blocks and secured therein.

3. A staple gun as claimed in claim 1 or 2, wherein said magazine has an elongate slot formed therein in parallel with each limb thereof so as to accept the legs of staples which is substantially "U" shaped.

* * * * *